US011380183B2

(12) United States Patent
Niu et al.

(10) Patent No.: US 11,380,183 B2
(45) Date of Patent: Jul. 5, 2022

(54) GAS ALARM REPLACEMENT WARNING METHOD AND DEVICE, AND ELECTRONIC APPARATUS INCLUDING THE DEVICE

(71) Applicant: Chengdu Qianjia Technology Co., Ltd., Chengdu (CN)

(72) Inventors: Fuzeng Niu, Chengdu (CN); Yong Zhao, Chengdu (CN); Yunhua Hu, Chengdu (CN); Liangwei Shen, Chengdu (CN); Bin Zhang, Chengdu (CN)

(73) Assignee: Chengdu Qianjia Technology Co., Ltd., Chengdu (CN)

( * ) Notice: Subject to any disclaimer, the term of this patent is extended or adjusted under 35 U.S.C. 154(b) by 41 days.

(21) Appl. No.: 17/255,891

(22) PCT Filed: Nov. 12, 2020

(86) PCT No.: PCT/CN2020/128432
§ 371 (c)(1),
(2) Date: Dec. 23, 2020

(87) PCT Pub. No.: WO2021/227409
PCT Pub. Date: Nov. 18, 2021

(65) Prior Publication Data

US 2022/0139193 A1 May 5, 2022

(30) Foreign Application Priority Data

May 12, 2020 (CN) ..... 202010394912.7

(51) Int. Cl.
*G08B 21/16* (2006.01)
*G08B 29/18* (2006.01)

(52) U.S. Cl.
CPC ..... *G08B 21/16* (2013.01); *G08B 29/185* (2013.01)

(58) Field of Classification Search
CPC .. G08B 21/16; G08B 29/185; G01N 33/0004; G01N 33/0006; G01M 15/05;
(Continued)

(56) References Cited

U.S. PATENT DOCUMENTS

2014/0312128 A1* 10/2014 Matsuoka ..... G05D 23/1917 236/51
2015/0106033 A1* 4/2015 Beerndt ..... G01N 33/0065 702/24

(Continued)

*Primary Examiner* — Orlando Bousono
(74) *Attorney, Agent, or Firm* — Andrew D. Fortney; Central California IP Group, P.C.

(57) ABSTRACT

The present application provides a gas alarm replacement warning method and device, and an electronic apparatus including the device. The method is applied to a gas alarm including a gas-sensitive element. The method includes: collecting signal data of the gas alarm; analyzing the current use state of the gas alarm based on the signal data; determining a dynamic model of the expected service life of the gas alarm according to the current use state, and calculating the expected use duration of the gas alarm; determining whether the actual use duration of the gas alarm is greater than the expected use duration; and if so, outputting a replacement prompt signal. Therefore, based on the expected service life of the gas alarm, when the use duration of the gas alarm approaches the expected service life, a replacement prompt signal is issued to solve the problem of untimely replacement of the gas alarm and ensure the safety of indoor gas use.

7 Claims, 3 Drawing Sheets

(58) Field of Classification Search
CPC ..... G05B 23/0221; G05B 23/0254; G05B 23/0283; G05B 23/0294
See application file for complete search history.

(56) References Cited

U.S. PATENT DOCUMENTS

| | | | | |
|---|---|---|---|---|
| 2015/0241304 | A1* | 8/2015 | Brummel | G01M 15/05 702/35 |
| 2018/0181149 | A1* | 6/2018 | Matsuoka | G05B 17/02 |
| 2020/0400636 | A1* | 12/2020 | Berndt | G01N 33/0006 |

* cited by examiner

GAS ALARM REPLACEMENT WARNING METHOD AND DEVICE, AND ELECTRONIC APPARATUS INCLUDING THE DEVICE

TECHNICAL FIELD

The present application relates to the technical field of indoor gas safety, and in particular to a gas alarm replacement warning method and device, and an electronic apparatus including the device.

TECHNICAL BACKGROUND

A household gas alarm is a device to detect household gas leakage and ensure the safety of gas consumption. All users who use gas should install a gas alarm. Most of the household gas alarms on the market use a gas-sensitive element as a sensor. The service life of the gas-sensitive element determines the service life of the household gas alarm. Generally speaking, the gas-sensitive element has the service life of 0.5-5 years. In addition, the service life of the household gas alarm is not only related to the gas-sensitive element, but also affected by the environment in which the household gas alarm is used. For example, when a kitchen is poorly ventilated, cooking oil fume is accumulated in a room, and then is adhered to the surface of the gas alarm to form oil dirt and block a ventilation hole of the gas alarm, causing alarm signals to lag, and even having a phenomenon of "no signal when being needed to signal" in severe cases. In addition, improper installation also greatly reduces the service life of the gas alarm. For example, the gas alarm cannot be directly opposite to a point that produces oily smoke and steam; the gas alarm cannot be installed in a location with direct ventilation; the gas alarm cannot be blocked by other objects; the gas alarm cannot be installed in a location that generates a lot of other gases, and so on.

At present, a user of the gas alarm does not have the awareness of regular detection or replacement of the gas alarm. Therefore, the failed household gas alarm cannot be replaced in time, making the installed gas alarm useless and unable to provide warning for gas leakage, causing a safety hazard of an indoor gas.

SUMMARY

The present application provides a gas alarm replacement warning method and device, and an electronic apparatus to realize that a gas alarm can be regularly detected, solving the problem of untimely replacement of the gas alarm, and ensuring the safety of indoor gas use.

To this end, one or more embodiments of the present application provides the following technical solutions:

A gas alarm replacement warning method is applied to a gas alarm comprising a gas-sensitive element, and the gas alarm replacement warning method comprises the following: collecting signal data of the gas alarm; analyzing the current use state of the gas alarm based on the signal data; determining a dynamic model of the expected service life of the gas alarm according to the current use state, and calculating the expected use duration of the gas alarm; determining whether the actual use duration of the gas alarm is greater than the expected use duration, and if so, outputting a replacement prompt signal.

The step of determining the dynamic model of the expected service life of the gas alarm according to the current use state comprises: determining a plurality of weighting factors that affect the service life according to the current usage state, and dynamically adjusting a basic model of the expected use duration of the gas alarm according to a plurality of determined weighting factors, to obtain the dynamic model.

The step of dynamically adjusting the basic model of the expected use duration of the gas alarm according to the plurality of determined weighting factors to obtain the dynamic model comprises: comparing the plurality of determined weighting factors with at least one weighting factor in the basic model, wherein when one or more of the at least one weighting factor in the basic model are not in the plurality of determined weighting factors, the one or more of the at least one weighting factors of the basic model has a value of 1; and the basic model is L=L0*E1*E2* . . . *En, where L is the expected use duration of the gas alarm, L0 is the reference use duration of the gas-sensitive element, E1*E2* . . . *En represents the at least one weighting factor, and n is a natural number.

The step of dynamically adjusting the basic model of the expected use duration of the gas alarm according to the plurality of determined weighting factors to obtain the dynamic model may further comprise: when one or more of the plurality of determined weighting factors are not in the weighting factors of the basic model, reconstructing the basic model so that the reconstructed basic model comprises the one or more of the at least one weighting factor.

A gas alarm replacement warning device comprises: a collection module, configured to acquire signal data of the gas alarm; an analysis module, configured to analyze the current use state of the gas alarm based on the signal data; a determination module, configured to determine the dynamic model of the expected service life of the gas alarm according to the current use state, and calculate the expected use duration of the gas alarm; a judgment module, configured to judge whether the actual use duration of the gas alarm is greater than or equal to the expected use duration; an output module, configured to output a replacement prompt signal when the judgment module outputs a judgment that the actual use duration of the gas alarm is greater than or equal to the expected use duration.

The determination module is configured to determine the dynamic model of the expected service life of the gas alarm according to the current use state by a process comprising: determining a plurality of weighting factors that affects the actual service life of the gas alarm according to the current use state; and dynamically adjusting a basic model of the expected use duration of the gas alarm according to the plurality of determined weighting factors, to obtain the dynamic model.

The determination module is configured to dynamically adjust the basic model of the expected use duration of the gas alarm according to the plurality of determined weighting factors by a process comprising: comparing the plurality of determined weighting factors with at least one weighting factor in the basic model, wherein when one or more of the at least one weighting factor in the basic model is not in the plurality of determined weighting factors, the one or more of the at least one weighting factor in the basic model has a value of 1; and the basic model is L=L0*E1*E2* . . . *En, where L is the expected use duration of the gas alarm, L0 is the reference use duration of the gas-sensitive element, E1*E2* . . . *En represents the at least one weighting factor, and n is a natural number.

The process by which the determination module dynamically adjusts the basic model of the expected use duration of the gas alarm according to the plurality of determined weighting factors may further comprise: when one or more of the determined weighting factors are not in the weighting factors of the basic model, reconstructing the basic model so that the reconstructed basic model comprises the one or more of the at least one weighting factor.

The gas alarm replacement warning device described herein may be applied to a gas alarm comprising a gas-sensitive element.

An electronic apparatus comprises a processor and a memory, wherein the memory stores certain instructions, and when the processor reads the instructions of the memory, the processor executes a gas alarm replacement warning method of any embodiment of the present application.

Compared with the prior art, the present application has the following the beneficial effects:

1. According to a detection signal mode of the gas alarm in different environments and installation processes, the corresponding characteristic parameter is analyzed and identified to judge the use environment and installation process of the gas alarm based on this, and then obtain the expected service life of the gas alarm more accurately.

2. Based on a sensor (the gas-sensitive element) in the gas alarm, the use environment and installation process of the gas alarm are combined. The dynamic model of the expected service life of the gas alarm is constructed. Based on changes in the use environment and installation process of the gas alarm, the expected service life of the gas alarm is dynamically obtained.

3. Based on the expected service life of the gas alarm, when the use duration of the gas alarm approaches the expected service life, a replacement prompt signal is issued to solve the problem of untimely replacement of the gas alarm and ensure the safety of indoor gas use.

BRIEF DESCRIPTION OF THE DRAWINGS

In order to more clearly describe the technical solutions of embodiments of the present application, the drawings that need to be used in the embodiments will be briefly introduced in the following. It should be understood that the following drawings only show certain embodiments of the present application, and therefore should be regarded as a limitation of the scope. The person skilled in the art obtains other related drawings from these drawings without creative work.

FIGURES

Figure 1:
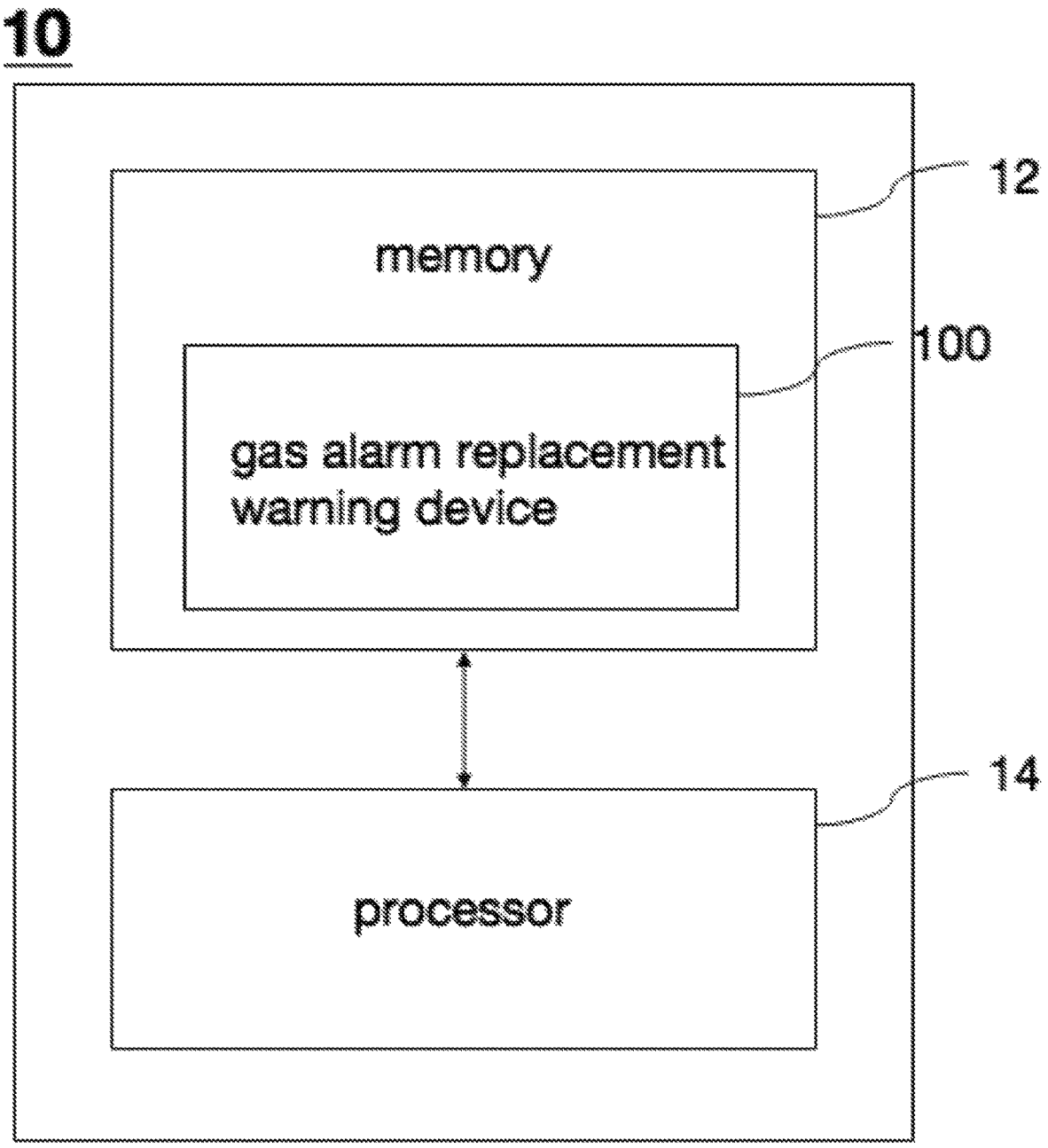
FIG. 1 is a diagram of an electronic device provided by an embodiment of the present application.

10—electronic apparatus; 12—memory; 14—processor; 100—gas alarm replacement warning device; 110—collection module; 120—analysis module; 130—determination module; 140—judgment module; 150—output module.

DETAILED DESCRIPTION

The technical solutions in embodiments of the present application will be clearly and completely described below in conjunction with the drawings in embodiments of the present application. Obviously, the described embodiments are only a part of embodiments of the present application, rather than all of the embodiments. The components of embodiments of the present application generally described and shown in the drawings herein can be arranged and designed in various different configurations. Therefore, the following detailed description of the embodiments of the present application provided in the accompanying drawings in the following is not intended to limit the scope of the claimed application, but merely represents selected embodiments of the present application. Based on embodiments of the present application, all other embodiments obtained by the person skilled in the art without creative work shall fall within the protection scope of the present application.

The technical solutions of the present application will be described in detail below in conjunction with the accompanying drawings.

Please refer to FIG. 1. FIG. 1 is an electronic apparatus 10 provided by an embodiment of the present application. The electronic apparatus 10 comprises a memory 12 and a processor 14. The memory 12 and the processor 14 are directly or indirectly electrically connected to each other in order to realize data transmission or interaction, wherein the electronic apparatus 10 can be a server, a terminal apparatus, or any apparatus with data storage and processing capabilities.

The memory 12 stores a software function module stored in the memory in the form of software or firmware, and the processor operates software program and a module that are stored in the memory, such as a gas alarm replacement warning device 100 in an embodiment of the present application, so as to execute various functional applications and data processing, that is, realize a gas alarm replacement warning method in an embodiment of the present application.

Figure 2:
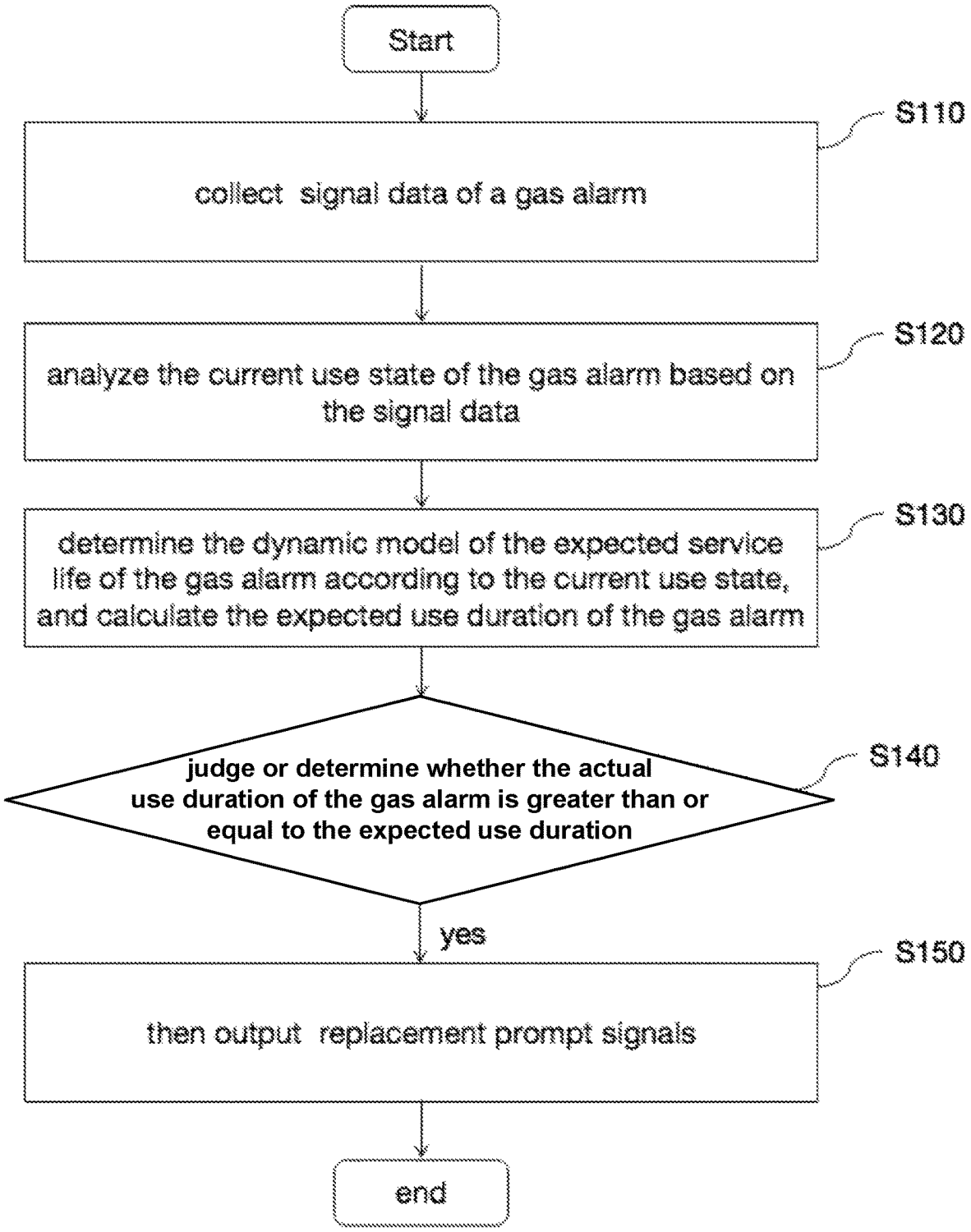
FIG. 2 is a flowchart of a gas alarm replacement warning method provided by an embodiment of the present application.

Please combine with FIG. 2. FIG. 2 is a flowchart of a gas alarm replacement warning method provided by an embodiment of the application. When the electronic apparatus 10 implements the gas alarm replacement warning method, steps S110-S150 are executed.

In step S110, collect signal data of a gas alarm.

In an embodiment of the present application, the signal data can be the signal data obtained when the gas alarm collects a gas in an environment, for example, gas data signals obtained by a sensor (usually a gas-sensitive element) in the gas alarm. The gas alarm sends the obtained data signal to the memory or other storage apparatuses for storage.

In an embodiment of the present application, a collection module 110 can directly and/or indirectly obtain the signal data uploaded by the gas alarm from the memory or a database via a network.

In step S120, analyze the current use state of the gas alarm based on the signal data.

In an embodiment of the present application, the current use state of the gas alarm comprises but is not limited to the use environment of the gas alarm and a current installation process of the gas alarm. The current use state of the gas alarm can be determined by at least one characteristic parameter comprised in the signal data.

In an embodiment of the present application, analysis and recognition are performed based on the signal data obtained by the gas alarm, and at least one characteristic parameter comprised in the signal data is determined. The characteristic parameter can comprise oil clogging, facing oily smoke or steam, a factor installed in a ventilation place or other factors, and so on. The characteristic parameter can directly and/or indirectly affect the actual service life of the gas alarm (the actual service life of the gas-sensitive element). In an embodiment of the present application, when analyzing the signal data, if a certain characteristic parameter appears, the corresponding current use state can be identified.

In an embodiment of the present application, the characteristic parameter can be obtained through a practical experiment and analysis of the signal data obtained by the gas alarm. For example, under normal conditions (for example, no oil dirt is formed on the surface of the gas alarm to block a ventilation hole of the gas alarm), the vibration frequency of detection signals obtained by the gas alarm conforms to a certain law, for example, the peak-to-peak value of the vibration and a signal period are within a specific range. Under special circumstances (for example, oil dirt is formed on the surface of the gas alarm to block the ventilation hole), the vibration of the detection signals obtained by the gas alarm varies from a specific range. For another example, when an installation position of the gas alarm is directly opposite to a point where the oil fume and steam are generated, detected signals also change from the specific range. Further, for example, when the gas alarm is installed in a location with direct ventilation, the detected signals also vary from a specific range.

In an embodiment of the present application, a rising slope or a signal fluctuation characteristic of a gas concentration value curve detected by the gas alarm is used to determine whether there is a problem of oil dirt plugging the hole. By determining whether the detected signals have larger periodic fluctuations (that is, determine whether the fluctuation range exceeds a set threshold range), it is determined whether the gas alarm is installed in a location with direct ventilation.

Step S130: determine a dynamic model of the expected service life of the gas alarm according to the current use state, and calculate the expected use duration of the gas alarm.

In an embodiment of the present application, a dynamic model of the expected use duration of the gas alarm is determined based on at least one characteristic parameter corresponding to the current use state. The dynamic model of the expected service life of the gas alarm can be obtained through an experiment in advance and is related to at least one characteristic parameter. The dynamic model of the expected service life of the gas alarm can determine the expected use duration of the gas alarm in the current use state based on at least one characteristic parameter corresponding to the current use state. For the specific steps of determining the dynamic model of the expected use duration of the gas alarm, please refer to the detailed description of the sub-steps of step 130 in FIG. 3.

In some embodiments, due to normal circumstances, the actual service life of one gas alarm depends on the actual service life of the gas-sensitive element installed therein, and the characteristic parameter can directly and/or indirectly affect the actual service life of the gas alarm. In an embodiment of the present application, the expected use duration of the gas alarm can indicate that the expected use duration of the gas alarm is obtained based on the actual use duration of the gas-sensitive element under the actual situation corresponding to at least one characteristic parameter (for example, oil dirt blocks the hole, the gas alarm faces oil fume or steam, or is installed in the ventilation place, and so on).

Step S140: judge whether the actual use duration of the gas alarm is greater than or equal to the expected use duration.

In an embodiment of the present application, it is determined whether the actual use duration of the gas alarm is greater than or equal to the expected use duration, that is, it is determined whether the actual use duration is close to the expected use duration. The expected use duration of the gas alarm can be calculated from the above-mentioned dynamic model. The actual use duration of the gas alarm refers to the accumulated actual use duration of the gas alarm up to current time. The expected use duration of the gas-sensitive element is related to the type of the gas-sensitive element installed in the gas alarm. Each type of gas-sensitive element corresponds to the expected use duration of one gas-sensitive element (one year, two years, three years, and so on), which is usually stored in the database or the memory.

In an embodiment of the present application, the expected use duration of the gas-sensitive element refers to a use duration value estimated according to the usage state of the gas-sensitive element and the factory performance of a product. In an embodiment of the present application, the elapsed duration of the gas alarm can be obtained by a timing unit built in the gas alarm. For example, after a household gas alarm is powered on, the built-in timing unit starts timing, records and stores the elapsed duration of the gas alarm.

In an embodiment of the present application, the step of judging whether the actual use duration of the gas alarm is greater than or equal to the expected use duration comprises: judge whether the expected use duration of the gas alarm is greater than or equal to the sum of the actual use duration of the gas alarm and a set redundancy duration. The redundancy duration is one set time threshold. The purpose of replacing a reminder is to prompt the replacement of the gas-sensitive element or the gas alarm before the actual use duration does not reach the service life to ensure the use reliability of the gas alarm. Therefore, it is necessary to set a time threshold of a redundancy duration to determine whether the actual use duration is close to the expected use duration.

Step S150, if so, output replacement prompt signals.

In an embodiment of the present application, when the expected use duration of the gas-sensitive element is greater than or equal to the expected use duration of the gas alarm, it means that the current used life of the gas alarm approaches the actual life of the gas alarm. Therefore, it is necessary to output replacement prompt signals to remind a household head to replace the gas alarm. In an embodiment of the present application, the replacement prompt signal can be a sound signal (an alarm sound), a light signal (a warning light is turned on), a vibration signal (continuous vibration), and so on.

In an embodiment of the present application, when the sum of the elapsed duration of the gas alarm and the redundancy duration is greater or equal to the expected use duration of the gas alarm, a replacement prompt signal is output.

In an embodiment of the present application, when the sum of the elapsed duration of the gas alarm and the redundancy duration is less than the expected use duration of the gas alarm, it means that the current gas alarm is still in normal working condition in a recent period. If the actual use duration of the gas alarm does not approach the expected use duration, no operation is performed.

Figure 3:
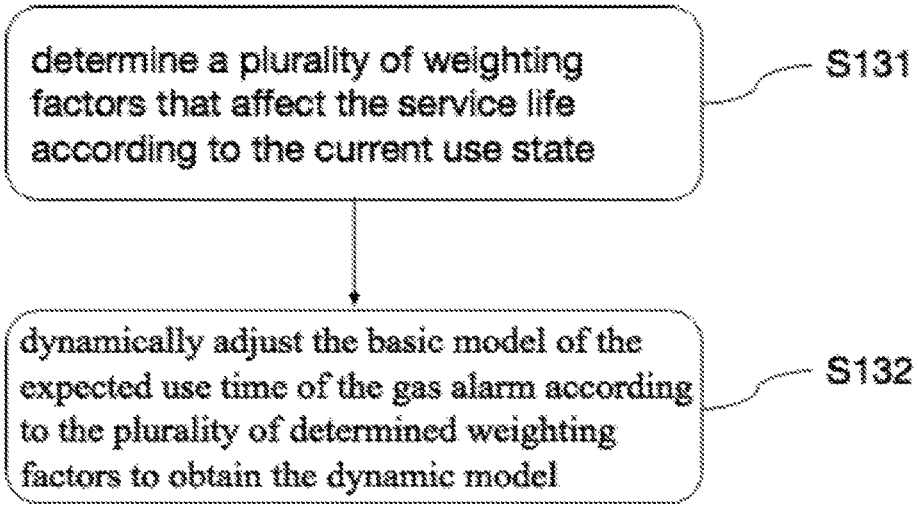
FIG. 3 is a flowchart of sub-steps of step S130 provided by an embodiment of the present application.

Please refer to FIG. 3. FIG. 3 is a flowchart of the sub-steps of S130 provided by the present application. In an embodiment of the present application, the sub-steps of step S130 comprise sub-step S131 and sub-step S132. The following is a detailed description of sub-step S131 and sub-step S132.

In sub-step S131, determine a plurality of weighting factors that affect the service life according to the current use state.

In an embodiment of the present application, the weighting factor of at least one characteristic parameter is determined based on at least one characteristic parameter in the current use state. One characteristic parameter corresponds to one influence weight En. For example, an oil congestion characteristic corresponds to one weight E1=0.7, and a characteristic installed in the ventilation place corresponds to one weight E2=0.12, where $0<En\leq 1$.

In an embodiment of the present application, based on the at least one characteristic parameter, the influence weight corresponding to the at least one characteristic parameter respectively can be determined through the Moncarrot method or historical data statistics stored in the database.

In sub-step S132, the basic model of the expected use duration of the gas alarm is dynamically adjusted according to the determined weighting factor to obtain the dynamic model.

In an embodiment of the present application, the basic model of the expected use duration of the gas alarm is dynamically adjusted according to a plurality of weighting factors corresponding to a plurality of determined characteristic parameters to obtain the dynamic model. The basic model can be the basic model obtained from an experiment and stored in the database or the storage apparatus. Based on the plurality of weighting factors, a parameter in the basic model is adjusted to obtain a dynamic model that conforms to the corresponding environmental state, which is used to obtain the expected use duration of the gas alarm.

In an embodiment of this application, based on the formula L=L0*E1*E2* . . . *En, the basic model for the expected use duration of the gas alarm is established. Where L is the expected use duration of the gas alarm; L0 is the expected use duration of the gas-sensitive element; E1*E2* . . . *En represents the weighting factor(s) of at least one characteristic parameter, and n is a natural number, that is, n=1, 2, 3, 4 . . . . The expected use duration L of the gas alarm can be dynamically calculated by this formula. For example, the expected use duration L0 of the gas-sensitive element is three years. The gas alarm comprises two characteristic parameters, such as oil congestion and installation in the ventilated place. The corresponding influence weights (weighting factors) are E1=0.7 and E2=0.12. Accordingly, the formula L can be used to calculate and obtain L=3*0.7*0.12=0.252 years. Under the circumstance when the gas alarm is blocked by oil and installed at a ventilated place, the gas-sensitive element with a service life expectancy of three years can fail in about 0.252 years. In a plurality of embodiments, the plurality of determined weighting factors are compared with the weighting factors in the basic model. If one or more weighting factors in the basic model do not comprise or include the plurality of determined weighting factors, the one or more weighting factors of the basic model have a value (e.g., En) of 1.

In a plurality of embodiments, if one or more of the determined weighting factors is not comprised in the weighting factor in the basic model, the basic model is reconstructed so that the reconstructed basic model comprises the one or more weighting factors. That is to say, when a new factor that affects the service life of the gas alarm is discovered, a new basic model needs to be re-established based on an experiment, so that the newly discovered factor is introduced into the new basic model.

Figure 4:
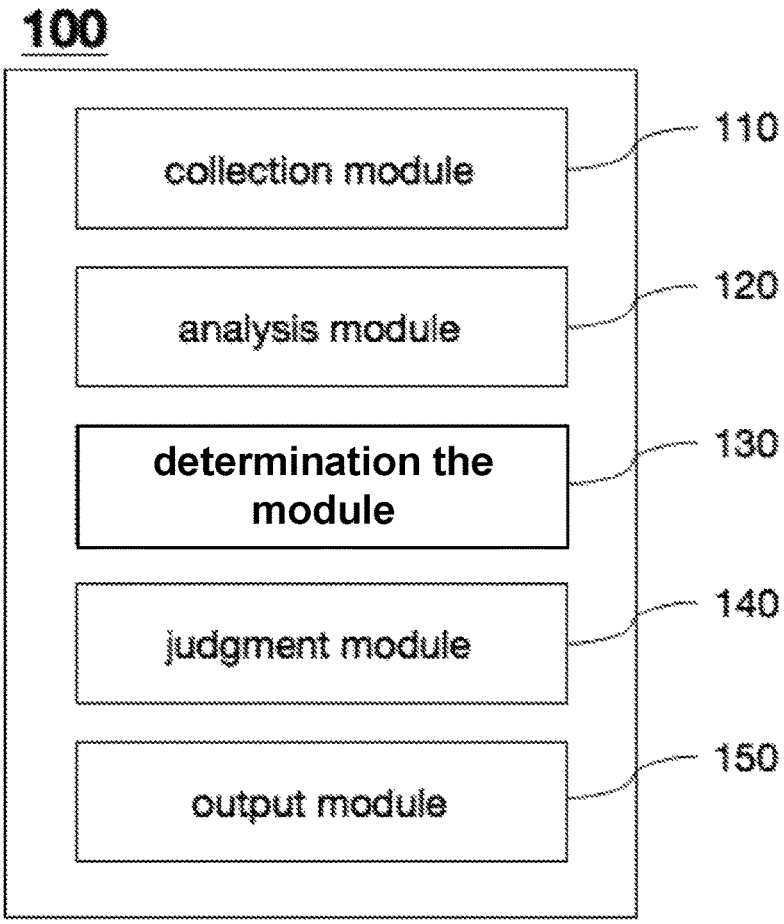
FIG. 4 is a diagram of a module of a gas alarm replacement warning device provided by an embodiment of the present application.

Please refer to FIG. 4. FIG. 4 is a diagram of a module of the gas alarm replacement warning device 100 provided by the present application. The gas alarm replacement warning device 100 comprises the collection module 110, an analysis module 120, a determination module 130, a judgment module 140, and an output module 150.

The collection module 110 is configured to collect the signal data of the gas alarm.

In an embodiment of the present application, the collection module 110 is configured to perform step S110 in FIG. 2. For the specific description of the collection module 110, please refer to the specific description of step S110 in FIG. 2.

The analysis module 120 is configured to analyze the current use state of the gas alarm based on the signal data.

In an embodiment of the present application, the analysis module 120 is configured to perform step S120 in FIG. 2. For the specific description of the analysis module 120, please refer to the specific description of step S120 in FIG. 2.

The determination module 130 is configured to determine the dynamic model of the expected service life of the gas alarm according to the current use state, and calculate the expected use duration of the gas alarm.

In an embodiment of the present application, the determination module 130 is configured to perform step S130 in FIG. 2. For the specific description of the determination module 130, please refer to the specific description of step S130 in FIG. 2.

The judgment module 140 is configured to judge whether the actual use duration of the gas alarm is greater than or equal to the expected use duration.

In an embodiment of the present application, the judgment module 140 is configured to execute step S140 in FIG. 2. For the specific description of the judgment module 140, please refer to the specific description of step S140 in FIG. 2.

The output module 150 is configured to output a replacement prompt signal when the judgment module 140 outputs a judgment result that the actual use duration of the gas alarm is greater than or equal to the expected use duration.

In an embodiment of the present application, the output module 150 is configured to execute step S150 in FIG. 2. For the specific description of the output module 150, please refer to the specific description of step S150 in FIG. 2.

In an embodiment of the present application, the process by which the determination module 130 determines the dynamic model of the expected service life of the gas alarm according to the current use state comprises: determining the plurality of weighting factors that affect the service life according to the current use state; and dynamically adjusting the basic model of the expected use duration of the gas alarm according to the plurality of determined weighting factors, to obtain the dynamic model.

In an embodiment of the present application, the determination module 130 dynamically adjusts the basic model of the expected use duration of the gas alarm according to the plurality of determined weighting factors, and the process by which the determination module 130 obtains the dynamic model further comprises comparing the plurality of determined weight factors with the weighting factor in the basic model. When one or more weighting factors in the basic model are not in the plurality of determined weighting factors, the one or more weighting factors in the basic model has the value of 1. The basic model is L=L0*E1*E2* . . .

*En, where L is the expected use duration of the gas alarm; L0 is the reference use duration of the gas-sensitive element, and E1*E2* . . . *En represents the weighting factor.

In an embodiment of the present application, the determination module 130 dynamically adjusts the basic model of the expected use duration of the gas alarm according to the plurality of determined weighting factors, and the process of obtaining the dynamic model further comprises: when the one or more of the plurality of determined weighting factors are not in the at least one weighting factor in the basic model, reconstructing the basic model so that the reconstructed basic model comprises the one or more of the at least one weighting factor.

The person skilled in the art can realize that units and algorithm steps of respective examples described in embodiments disclosed herein can be implemented by an electronic hardware, computer software, or a combination of the two. In order to clearly illustrate the interchangeability of a hardware and software, in the above description, the composition and steps of respective examples have been generally described in accordance with a function. Whether these functions are executed by the hardware or software depends on the specific application and design constraints of the technical solutions. Professionals and technicians can use different methods for each specific application to implement the described functions, but such implementation should not be considered as going beyond the scope of the present invention.

If being implemented in the form of a software functional unit and sold or used as an independent product, an integrated unit can be stored in a computer readable storage medium. Based on this understanding, the technical solution of the present invention is essentially the part that contributes to the prior art, or all or part of the technical solutions can be embodied in the form of a software product. A computer software product is stored in one storage medium and comprises a plurality of instructions to make a computer apparatus (which can be a personal computer, a server, or a network apparatus, and so on.) execute all or part of the steps of the method in each embodiment of the present invention. The aforementioned storage media comprise: a U disk, a mobile hard disk, a read-only memory (ROM, Read-Only Memory), a random access memory (RAM, Random Access Memory), a magnetic disk or an optical disk and other media that can store program codes.

The above are only specific embodiments of the present invention, but the protection scope of the present invention is not limited thereto. The person skilled in the art can easily think of changes or substitutions within the technical scope disclosed by the present invention, which should be covered within the protection scope of the present invention. Therefore, the protection scope of the present invention should be subject to the protection scope of the claims.

What is claimed is:

1. A gas alarm replacement warning method, wherein the method is applied to a gas alarm comprising a gas-sensitive element, and the gas alarm replacement warning method comprises:

collecting signal data of the gas alarm;

analyzing a current use state of the gas alarm based on the signal data;

determining a dynamic model of an expected service life of the gas alarm according to the current use state, and calculating an expected use duration of the gas alarm; and determining whether an actual use duration of the gas alarm is greater than the expected use duration, and if so, outputting a replacement prompt signal, wherein:

determining the dynamic model of the expected service life of the gas alarm according to the current use state comprises:

determining a plurality of weighting factors that affect an actual service life of the gas alarm according to the current use state; and dynamically adjusting a basic model of the expected use duration of the gas alarm according to a plurality of determined weighting factors, to obtain the dynamic model;

dynamically adjusting the basic model of the expected use duration of the gas alarm according to the plurality of determined weighting factors to obtain the dynamic model comprises:

comparing the plurality of determined weighting factors with at least one weighting factor in the basic model, wherein when one or more of the at least one weighting factor in the basic model are not in the plurality of determined weighting factors, the one or more of the at least one weighting factor in the basic model has a value of 1; and the basic model is L=L0*E1*E2* . . . *En, where L is the expected use duration of the gas alarm, L0 is a reference use duration of the gas-sensitive element, E1*E2* . . . *En represents the at least one weighting factor, and n is a natural number.

2. The gas alarm replacement warning method according to claim 1, characterized in that dynamically adjusting the basic model of the expected use duration of the gas alarm according to the plurality of determined weighting factors further comprises:

when one or more of the plurality of determined weighting factors are not in the at least one weighting factor in the basic model, reconstructing the basic model so that the reconstructed basic model comprises the one or more of the at least one weighting factor.

3. An electronic apparatus, comprising a processor and a memory, wherein the memory stores instructions, and when the processor reads the instructions of the memory, the processor executes a gas alarm replacement warning method according to claim 1.

4. An electronic apparatus, comprising a processor and a memory, wherein the memory stores instructions, and when the processor reads the instructions of the memory, the processor executes a gas alarm replacement warning method according to claim 2.

5. A gas alarm replacement warning device, comprising:

a collection module, configured to acquire signal data of the gas alarm;

an analysis module, configured to analyze a current use state of the gas alarm based on the signal data;

a determination module, configured to determine a dynamic model of an expected service life of the gas alarm according to the current use state, and calculate an expected use duration of the gas alarm;

a judgment module, configured to judge whether an actual use duration of the gas alarm is greater than or equal to the expected use duration; and an output module, configured to output a replacement prompt signal when the judgment module outputs a judgment that the actual use duration of the gas alarm is greater than or equal to the expected use duration, wherein:

the determination module is configured to determine the dynamic model of the expected service life of the gas alarm according to the current use state by a process comprising:

determining a plurality of weighting factors that affect an actual service life of the gas alarm according to the current use state; and dynamically adjusting a basic model of the expected use duration of the gas alarm according to the plurality of determined weighting factors, to obtain the dynamic model;

the determination module is configured to dynamically adjust the basic model of the expected use duration of the gas alarm according to the plurality of determined weighting factors to obtain the dynamic model by a process comprising:

comparing the plurality of determined weighting factors with at least one weighting factor in the basic model, wherein when one or more of the at least one weighting factor in the basic model is not in the plurality of determined weighting factors, the one or more of the at least one weighting factor in the basic model has a value of 1; and the basic model is L=L0*E1*E2* . . . *En, where L is the expected use duration of the gas alarm, L0 is a reference use duration of the gas-sensitive element, E1*E2* . . . *En represents the at least one weighting factor, and n is a natural number.

6. The gas alarm replacement warning device according to claim 5, wherein the process by which the determination module is configured to dynamically adjust the basic model of the expected use duration of the gas alarm according to the plurality of determined weighting factors further comprises:

when one or more of the determined weighting factors are not in the at least one weighting factor of the basic model, reconstructing the basic model so that the reconstructed basic model comprises the one or more of the at least one weighting factor.

7. A gas alarm, comprising a gas-sensitive element and the gas alarm replacement warning device of claim 5.

* * * * *